United States Patent [19]

Muller, Jr. et al.

[11] 3,966,247

[45] June 29, 1976

[54] KEYLESS PADLOCK

[75] Inventors: Fred Muller, Jr., Florham Park, N.J.; Stanley Wolniak, Chicago, Ill.; Marshall Johnson, Mundelein, Ill.; Elbert Spencer, Wildwood, Ill.

[73] Assignee: Madge Canter Associates, Inc., West Orange, N.J.

[22] Filed: June 4, 1973

[21] Appl. No.: 366,750

[52] U.S. Cl. ..... 292/318

[51] Int. Cl. ..... E05c 19/18

[58] Field of Search ..... 292/306, 318, 319, 330, 292/322

[56] References Cited

UNITED STATES PATENTS

| | | | |
|---|---|---|---|
| 622,599 | 4/1899 | Brooks | 292/318 |
| 737,039 | 8/1903 | Stone | 292/306 |
| 997,234 | 7/1911 | Brooks | 292/318 |
| 1,553,188 | 9/1925 | Sauton | 292/318 |
| 1,930,560 | 10/1933 | Keidell | 292/318 |
| 1,964,013 | 6/1934 | Wenk | 292/320 |

*Primary Examiner*—Richard E. Moore

*Attorney, Agent, or Firm*—Stoll & Stoll

[57] ABSTRACT

A keyless padlock seal for shipping containers, highway trailers, railroad box cars and the like, comprising .ock body and a hasp which is spring-locked to said lock body. The hasp cannot be removed from the body without destruction of either the hasp or the body. A code-marked seal may be provided on the lock body and secured thereto in such manner that it cannot be removed or replaced without at least partial destruction of the padlock and evidence of tampering.

3 Claims, 28 Drawing Figures

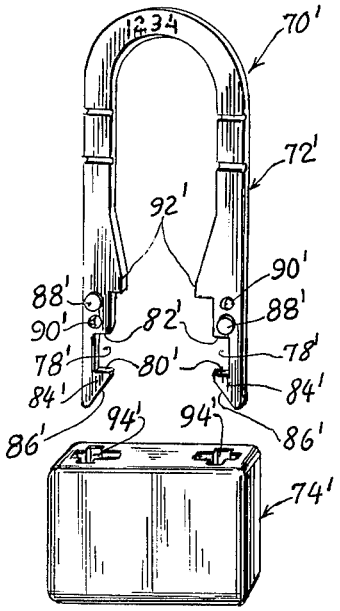
Fig. 14
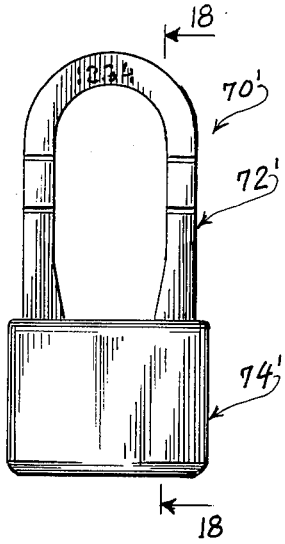
Fig. 15
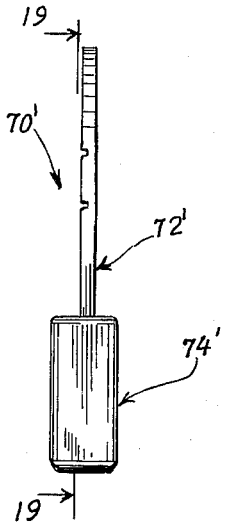
Fig. 16
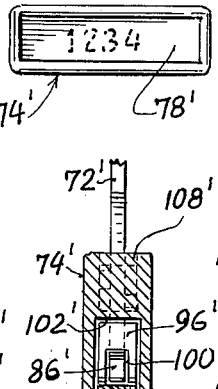
Fig. 17
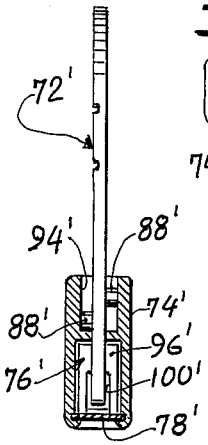
Fig. 18
Fig. 21
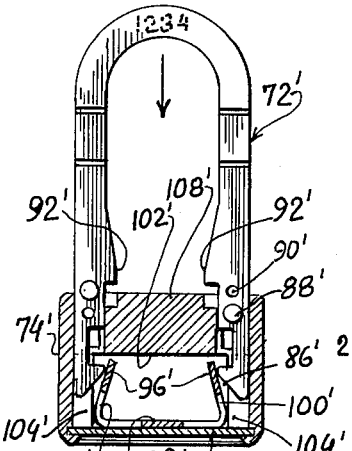
Fig. 20
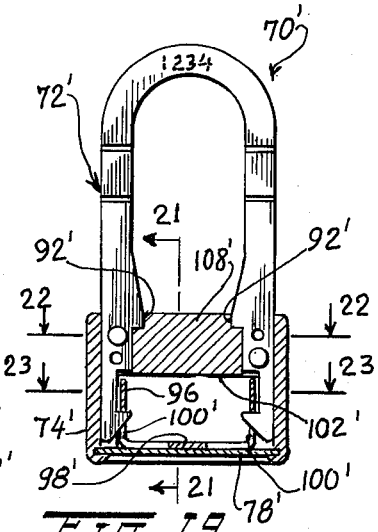
Fig. 19
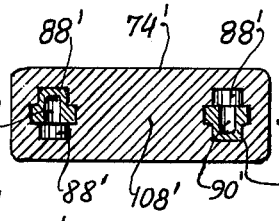
Fig. 22
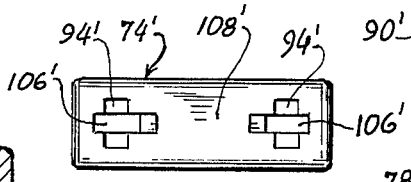
Fig. 24
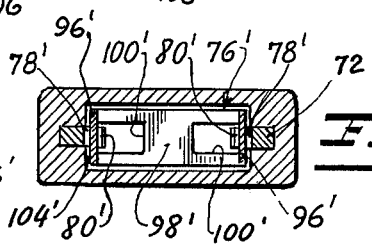
Fig. 23
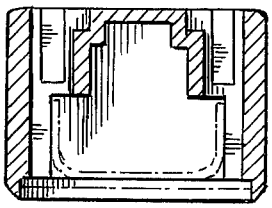
Fig. 26
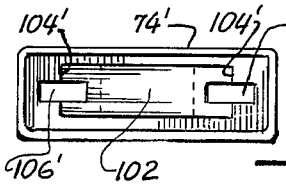
Fig. 25

KEYLESS PADLOCK

BACKGROUND OF THE INVENTION

1. Field of the Invention.

Cargo security seals for shipping enclosures transported by rail, highway, air or marine facilities. The object of such security seals is to combat cargo theft and pilferage.

2. Description of Prior Art.

The closest patent art known to applicant is U.S. Pat. No. 3,602,538, issued to Gilbert Canter on Aug. 31, 1971 for a Padlock Seal. This patent shows a padlock seal which is intended to perform substantially the same purpose as is performed by the present invention. However, the patented padlock seal is a relatively expensive device, consisting of a number of component parts requiring pre-assembly by the manufacturer. It is not economically conducive to use as a disposable seal.

The present invention is related, in principle, to applicant's invention which is described and claimed in his co-pending patent application, Ser. No. 267,517, filed concurrently herewith. The title of applicant's co-pending case is Keyless Padlock Seal. In both cases the hasp is spring-locked to the lock body. In the co-pending case it is the hasp itself which is spring-biased, and no separate spring element is required to interlock the hasp with the lock body. In the present case, on the other hand, a spring element, separate and apart from the hasp, is provided between the hasp and the lock body. It is this spring element which in the present case spring-locks the hasp to the lock body.

SUMMARY OF THE INVENTION

The present invention provides a keyless padlock seal consisting of three operative parts, namely: a lock body, a hasp, and spring means for interlocking said hasp with said lock body. The lock body and spring — or the hasp and spring — are assembled by the manufacturer. The hasp is joined with the lock body by the shipper. Joinder of the hasp to the lock body requires the simple act of inserting the hasp legs into the lock body with sufficient force to overcome the tension of the spring. spring-engaging formations are provided on the hasp legs — or, alternatively, in the lock body. Once these spring-engaging formations are brought into engagement with the spring, the hasp is interlocked with said lock body and cannot be removed except by destruction of the lock body or hasp and the spring which interlocks them.

The keyless padlock of the present invention also includes a seal, usually code-marked, which is attached to the lock body. Depending on the nature of the seal and the means for securing same to the lock body, the seal-securing operation is performed either by the manufacturer or by the shipper. As illustrated in the drawing, the seal may take the form of a seal plate which is secured to by the bottom of the lock body by the means of a swaged periperal flange.

BRIEF DESCRIPTION OF THE DRAWING

FIG. 14 is a perspective exploded view of a padlock seal made in accordance with still another form of the present invention, the hasp and the lock body being shown separately.

FIG. 15 is a view of the same padlock seal, showing the hasp engaged with the lock body.

FIG. 16 is a side edge view of the padlock seal shown in FIG. 15.

FIG. 17 is a bottom view of said padlock seal showing its code-marked seal.

FIG. 18 is a section on the line 18—18 of FIG. 15.

FIG. 19 is a section on the line 19—19 of FIG. 16.

FIG. 20 is a view similar to that of FIG. 19, except that the hasp is shown approaching its interlocking position with respect to the lock body.

FIG. 21 is a fragmentary section on the line 21—21 of FIG. 19.

FIG. 22 is a section on the line 22—22 of FIG. 19.

FIG. 23 is a section on the line 23—23 of FIG. 19.

FIG. 24 is a top view of the lock body, the hasp being omitted from this view.

FIG. 25 is a bottom view of the lock, the hasp and seal plate being omitted from this view.

FIG. 26 is a sectional view through a modified form of lock body.

DESCRIPTION OF PREFERRED EMBODIMENTS OF INVENTION

Figure 1:
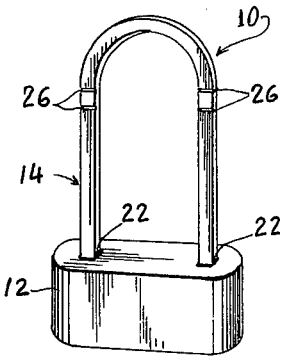
FIG. 1 is a perspective view of a keyless padlock seal made in accordance with one form of the present invention.

Padlock seal 10, made in accordance with one form of this invention (see FIGS. 1–9), comprises a lock body 12, a hasp 14 for said lock body, a pair of lock spring elements 16 for interlocking said hasp with said lock body, and a coded seal 18 which is secured to the bottom of the lock body and forms a closure therefor. More particularly, hasp 14 is or may be a generally U-shaped element having a pair of legs **14*a* and 14*b*, respectively, joined by a bowed portion or bight 14***c*. At the lower ends of hasp legs 14*a* and 14*b* are notches 20 defined by an inclined upper end 20*a* and a lower shoulder 20*b* which extends substantially at right angles to the longitudinal axes of said hasp legs.

Figure 8:
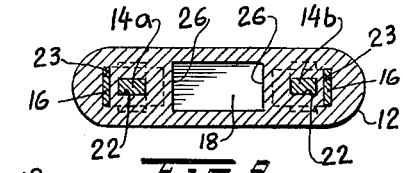
FIG. 8 is a fragmentary section on the line 8—8 of FIG. 5.
Figure 6:
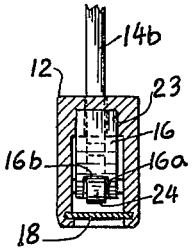
FIG. 6 is a fragmentary section of the line 6—6 of FIG. 5.
Figure 7:
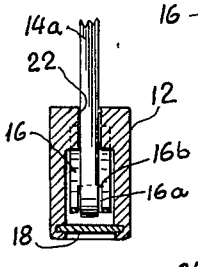
FIG. 7 is a fragmentary section on the line 7—7 of FIG. 5.
Figure 9:
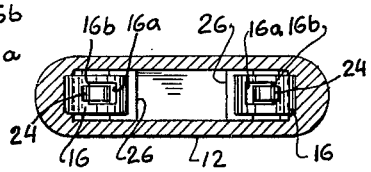
FIG. 9 is a fragmentary section on the line 9—9 of FIG. 5.
Figure 5:
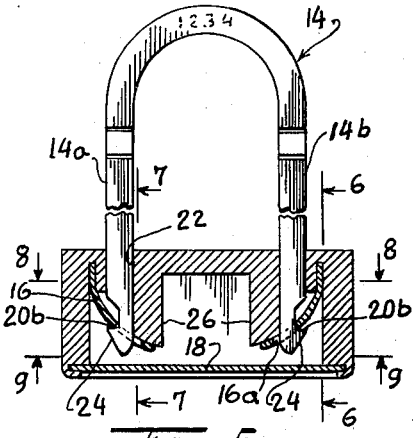
FIG. 5 is a view similar to that of FIG. 4, but showing the hasp legs in interlocking engagement with the lock spring elements.

Hasp legs 14*a* and 14*b* are rectanglar in cross-section, and lock body 12 has a pair of rectangular holes 22 formed therein to receive said hasp legs. This is best shown in FIGS. 8 and 9. It will be observed that the lock springs are press-fitted into a pair of slits 23 formed in the lock body adjacent holes 22, but this is purely illustrative and any other method or means of securing the lock springs to the lock body may be used.

Lock springs 16 may be generally arcuate in longitudinal section (FIGS. 3, 4, 5), and they are provided with slots 16*a* formed therein. The shape and dimensions of slots 16*a* correspond, substantially, to the cross-sectional shape dimensions of the legs of the hasp with sufficient additional space for clearance.

Figure 3:
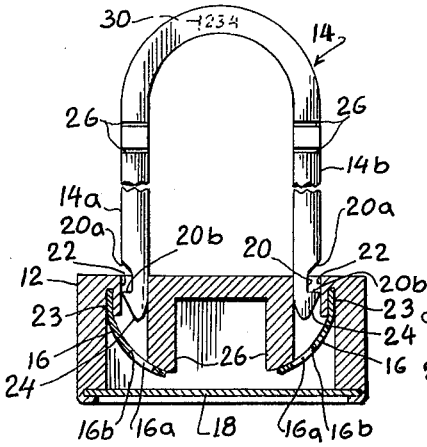
FIG. 3 is a enlarged view partly in section, showing the hasp of said padlock partially inserted into the lock body and prior to engagement with the lock spring elements.
Figure 4:
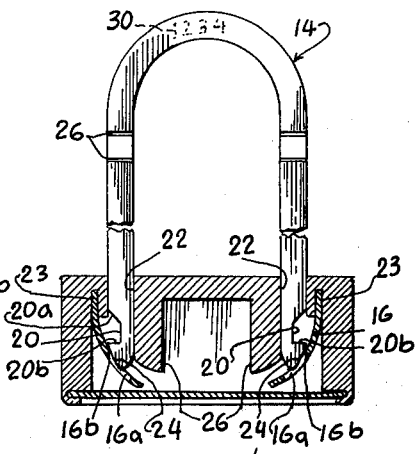
FIG. 4 is a fragmentary sectional view similar to that of FIG. 3, but showing the hasp legs in camming engagement with the lock spring elements.
Figure 2:
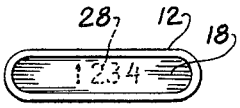
FIG. 2 is a view of the bottom of said padlock, showing its code-marked seal.

When the lock springs are in their FIG. 3 positions, that is, prior to engagement by the hasp legs, slots 16*a* are disaligned from rectangular holes 22 in the lock body, and hence disaligned from the hasp legs themselves. When the hasp legs are brought into contact with the lock springs, as shown in FIG. 4, it is necessary for the hasp legs to cam the lock springs downwardly and outwardly in order to bring slots 16*a* into registration with holes 22 and hence with the hasp legs. When this occurs, the hasp legs will pass through slots 16*a* (see FIG. 5), and the lock springs will thereby be released to return to their original position and configuration as shown in FIG. 3.

In order for the hasp legs to cam the lock springs into positions wherein slots 16*a* register with holes 22, it is desirable that the leading ends of the hasp legs be tapered to provide suitable cam faces. Reference is here made to tapered cam face surfaces 24. FIG. 4 shows how these cam faces engage the lock springs and cam them into hasp leg engaging positions. Once the hasp legs enter slots 16*a* in the lock spring, said lock springs will spring back, as hereinabove mentioned, to their original positions wherein slots 16*a* are disaligned from lock body holes 22. This is possible because of notches 20 in the hasp legs, and it will be noted that the end walls 16*b* which define the upper ends of slots 16*a* project into notches 20 and engage shoulders 20*b* of the hasp legs. It is this locking engagement between end walls 16*b* and shoulders 20 which locks the hasp to the lock springs and hence to the lock body.

Removal of the hasp from the lock body will be strongly resisted. The reason is that the upper ends of the lock springs are securely anchored in slits 23 of the lock body, and the lower ends of said lock springs are adequately supported by abutments 26 of the lock body. In short, both ends of each lock spring are securely supported to resist an attempt to draw the lock hasp out of the lock body.

It is of course intended that the hasp be ultimately ruptured for the purpose of removing the entire lock seal from whatever container, truck trailer body or like object the lock seal is designed to secure. Score lines 26 are accordingly formed across the upper leg portions of the hasp, and the hasp may be ruptured along these score lines by means of a suitable tool.

As the drawing indicates, seal plate 18 may have code figures 28 stamped therein or otherwise permanently applied thereto. Code figures 30 may also be stamped into or otherwise permanently applied to the hasp, preferably, but not necessarily, bight 14*c*.

Figure 10:
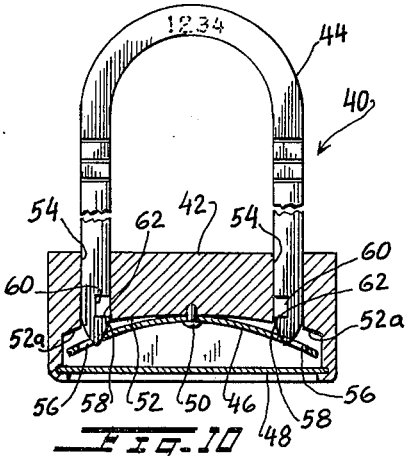
FIG. 10 is a fragmentary sectional view showing a padlock seal made in accordance with a second form of this invention, the hasp legs being shown prior to locking engagment with the spring.
Figure 11:
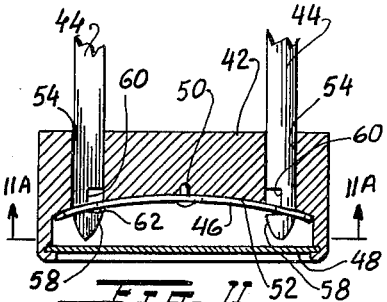
FIG. 11 is a fragmentary sectional view wherein the hasp legs are shown in interlocking engagement with the lock spring element.
Figure 11A:
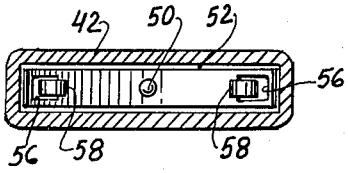
FIG. 11A is a sectional view on the line 11A—11A of FIG. 11.

Turning now to the second form of this invention as illustrated in FIGS. 10, 11 and 11A, it will be observed that lock seal 40 comprises a lock body 42, a hasp 44, a lock spring 46, and a seal plate 48. Hasp 44 is of substantially the same configuration as hasp 14 above described. There is, however, only one lock spring 46 to take the place and perform the functions of lock springs 16.

It will be noted that lock spring 46 is secured by means of a fastening element 50 to an arcuately shaped wall 52 formed in the lock body. Extending through the lock body and through arcuate wall 52 is a pair of holes 54 which accommodate the hasp legs. Since the hasp legs are rectangular in cross-section, so are holes 54, and the cross-sectional dimensions of the hasp legs and holes for same correspond, except for additional clearance space.

Prior to engagement by the hasp legs, lock spring 46 rests against arcuate wall 52 of the lock body. Slots 56 in lock spring 46 are at this time disaligned from holes 54 in the lock body. Accordingly, when the hasp legs are inserted into the lock body through holes 54, the lead ends of the hasp legs must cam the lock spring downwardly in the manner shown in FIG. 10 until lock spring slots 56 are brought into registration with lock body holes 54. For this purpose, as in the first form of the invention, the lead ends of the hasp legs are provided with cam faces 58. Once slots 56 register with holes 54, the hasp legs will enter said slots 56, and the lock spring will spring back to its original position against wall 52, as shown in FIG. 11. This becomes possible by reason of notches 60 formed in the hasp legs. Shoulders 62, defining the lower walls of said notches, engage the lock spring to lock the hasp to the lock body.

Once again, it is noted that the lock spring is fully supported by the lock body. The center portion of the lock spring intermediate the hasp legs is supported by arcuate wall 52 of the lock body. The outer ends of the lock spring on the opposite sides of the hasp legs are supported by end portions 52a of arcuate wall 52.

Figure 12:
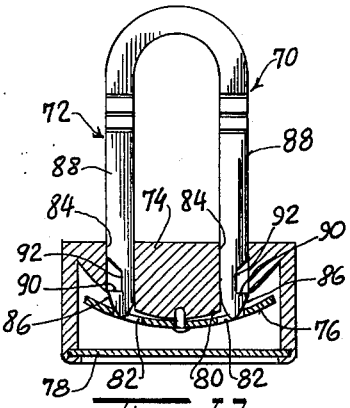
FIG. 12 is a sectional view of a keyless padlock seal made in accordance with a third form of this invention.
Figure 13:
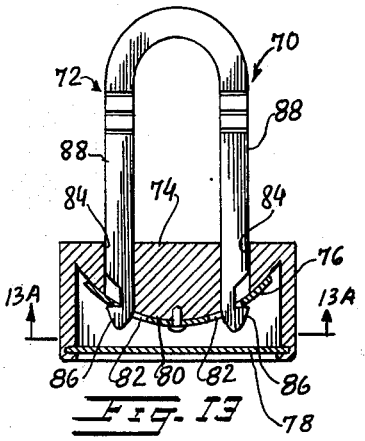
FIG. 13 is a view similar to that of FIG. 12, but showing the hasp legs in interlocking engagement with the lock spring element.
Figure 13A:
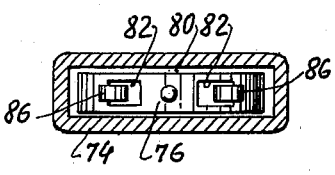
FIG. 13A is a sectional view of the line 12A—13A of FIG. 13.

The third form of the invention is illustrated in FIGS. 12–13A, and it will be seen that lock seal 70 comprises a hasp 72, a lock body 74, a lock spring 76 and a seal plate 78. Essentially, lock seal 70 corresponds to lock seal 40 last above described. The only difference redides in the direction of curvature of the lock spring and its supporting wall in the lock body. In FIGS. 10 and 11 it will be seen that arcuate wall 52 defines a concave configuration facing downwardly. In FIGS. 12 and 13 arcuate wall 80 defines a convex configuration facing downwardly. Slots 82 of lock spring 76 are normally out of alignment with holes 84 in lock body 74, and it is necessary for cam faces 86 at the lead ends of hasp legs 88 to cam the lock spring downwardly until its slots register with holes 84. When this occurs, the lead ends of the hasp legs pass through slots 82, and shoulders 90 in notches 92 engage the lock spring to securely lock the hasp to the lock body. As in the case of the embodiment of the invention shown in FIGS. 10 and 11, lock spring 76 is adequately supported by arcuate wall 80 on both sides of each of the hasp legs.

Referring now to the fourth form of the invention, as shown in FIGS. 14–25 of the drawing, it will be observed that padlock seal 70′ comprises a hasp 72′ and a lock body 74′, said lock body having a spring locking element 76' and a seal plate 78' which functions as a closure for said lock body 74'. As in the embodiments of the invention above described, it is the inter-engagement of the hasp 72' with the spring locking element 76' that locks the hasp to the lock body.

More particularly, hasp 72' is a generally U-shaped element which may be stamped or die-cast or otherwise formed in the configuration shown in the drawing. The legs of the U-shaped hasp are provided at their lower ends with notches 78' formed between shoulders 80' and 82'. Shoulders 80' face upwardly, and they are formed on the upper ends of detents 34'. The lower faces 86' of said detents 84' are beveled or angled to function in the manner of cam faces with respect to the locking element as hereinafter more fully described.

Formed on the legs of the U-shaped hasp, above notches 78', are bosses 88' and 90', bosses 88' projecting laterally from one side of the hasp, bosses 90' projecting laterally from the opposite side of the hasp. Above these bosses 88' and 90' are inwardly projecting enlargements 92' formed on the inner sides of the legs of the hasp.

Lock body 74' is generally hollow and is provided with a pair of openings 94' at the top, through which the legs of the hasp are inserted. An opening is provided at the bottom of the lock body through which lock spring element 76' may be inserted, and, as has above been indicated, seal plate 78' is secured to the bottom of the lock body to confine the lock spring element therein.

As will be seen, lock spring element 76' is a generally U-shaped leaf spring whose arms 96' project upwardly and whose base 98' rests on the seal plate 78'. Hasp leg reception holes 100' are formed in both arms of said lock spring element to receive the hasp legs.

It will be noted that the internal configuration of lock body 74' is such that a shoulder or shoulders 102' are provided therein to serve as limit abutments for the upper ends of the arms of the lock spring element. Side wall abutments 104' are provided in the lock body, and the arms of the lock spring are biased outwardly for engagement therewith. In short, the lock spring element is confined within the lock body by means of shoulders 102', walls 104' and the seal plate 78'.

Slots 106' are formed in walls 104' to provide passageways for the legs of the hasp. The slots are continuous through the upper body portion 108' of the lock body, and they coincide at least in part, with openings 94' above mentioned. As will shortly be seen, openings 94' are somewhat wider than slots 106', to accommodate inwardly facing enlargements 92' and lateral embossments 88' on the hasp.

When the hasp legs are inserted into the lock body 74', as shown in FIG. 20, cam-faced detents 84' engage arms 96' of the lock spring element and force them inwardly toward each other against their spring bias. Further movement of the hasp legs into the lock body causes said detents to enter holes 100' in the spring element, as shown in FIG. 19, thereby interlocking the hasp with the lock spring element and the lock body. Upwardly facing shoulders 80' on detents 84' function as abutments to prevent the detents from being pulled upwardly out of the spring holes, and since said spring is confined to the lock body, this prevents the hasp from being pulled upwardly and dislodged from the lock body.

For the purposes of the claims, the formations delineated by cam faces 86' and shoulders 80' are called "barb formations". Also for the purposes of the claims, it is noted that the hasp legs as shown in the drawing are generally parallel to each other and non-circular (rectangular) in cross-section.

The foregoing forms of the invention are illustrative of the principles of the invention and may be modified as desired or required within within the scope of the appended claims.

For the purposes of the claims, the formations delineated by cam faces 86' and shoulders 80' are called "barb formations". Also for the purposes of the claims, it is noted that the hasp legs are shown in the drawing are generally parallel to each other and non-circular (rectangular) in cross-section.

We claim:

1. A keyless padlock of the character described, comprising:

a. a lock body having a cavity formed therein, on one side thereof, b. a seal plate secured to said lock body to close said open side, c. a pair of spaced access holes formed in said lock body for access into said cavity and a pair of abutments formed in said lock body adjacent said access holes, d. a generally U-shaped hasp consisting of a bight and a pair of generally parallel legs depending from said bight and adapted to be inserted into said lock body cavity through said access holes, e. said hasp legs having a pair of barb formations at their lower ends, with downwardly directed cam-faces and upwardly directed abutment shoulders above said cam faces, and f. lock spring means, confined in said lock body cavity between the abutments formed therein and the seal plate, for interlocking engagement with said hasp leg barb formations to interlock the hasp with the lock body, g. said lock spring means comprising a generally U-shaped leaf spring having a bight and a pair of generally parallel arms extending upwardly therefrom and a pair of reception holes formed in said arms adjacent said bight, h. said cam-faces on the hasp leg barb formations being oriented to engage the leaf spring arms, when the hasp legs are inserted into the lock body through said access holes, to cam said leaf spring arms laterally into spring-biased, non-parallel positions, i. said hasp leg barb formations being registrable with the reception holes in the leaf spring arms when the hasp legs are fully seated in the lock body, j. whereby the leaf spring arms are disengaged from the cam faces on said barb formation and spring back to generally parallel positions, trapping the barb formations in said reception holes, k. said barb formations being locked in said reception holes by means of the abutment shoulders on the barb formations.

2. A keyless padlock in accordance with claim 1, wherein:

a. the access holes in the lock body are stepped holes, larger at their upper ends and smaller at their lower ends, and b. the hasp legs are provided with laterally extending formations which occupy the larger ends of the stepped holes when the hasp legs are fully seated in the lock body, c. thereby preventing insertion into and through said access holes of instruments designed to spring the leaf spring arms out of locking engagement with the barb formations on the hasp legs for unauthorized opening of the padlock.

3. A keyless padlock in accordance with claim 1, wherein:

the hasp legs and access holes are non-circular in transverse section.

* * * * *